United States Patent [19]

Yamamoto

[11] Patent Number: 4,776,518

[45] Date of Patent: Oct. 11, 1988

[54] FUEL INJECTION VALVE USED IN FUEL INJECTION APPARATUS FOR INTERNAL COMBUSTION ENGINE

[75] Inventor: Yoshihisa Yamamoto, Kariya, Japan

[73] Assignee: Nippondenso Co., Ltd., Kariya, Japan

[21] Appl. No.: 36,901

[22] Filed: Apr. 10, 1987

[30] Foreign Application Priority Data

Apr. 11, 1986 [JP] Japan ..... 61-84780
Jun. 28, 1986 [JP] Japan ..... 61-152085

[51] Int. Cl.[4] ..... F02M 47/00
[52] U.S. Cl. ..... 239/533.4; 239/533.8
[58] Field of Search ..... 239/88, 93–97, 239/533.3–533.5, 533.8, 533.9

[56] References Cited

U.S. PATENT DOCUMENTS

| | | | |
|---|---|---|---|
| 3,738,576 | 6/1973 | O'Neill | 239/533.8 |
| 3,997,117 | 12/1976 | Köhler et al. | 239/533.8 |
| 4,165,724 | 8/1979 | Yamamoto et al. | 123/139 |
| 4,167,168 | 9/1979 | Yamamoto | 123/139 |
| 4,402,456 | 9/1983 | Schneider | 239/90 |
| 4,403,740 | 9/1983 | Eblen et al. | 239/553.8 |
| 4,427,152 | 1/1984 | Sisson | 239/90 |
| 4,684,067 | 8/1987 | Cotter et al. | 239/533.3 |

FOREIGN PATENT DOCUMENTS

| | | |
|---|---|---|
| 59-48302 | 11/1984 | Japan . |
| 60-60032 | 12/1985 | Japan . |

OTHER PUBLICATIONS

"UFIS–A New Diesel Injection System", J. A. Kimberley et al., American Bosch Div., AMBAC Industries, Inc., Society of Automotive Engineers, International Automotive Engineering Congress and Exposition, Detroit, 2/28–3/4/77.

*Primary Examiner*—Andres Kashnikow
*Assistant Examiner*—Karen B. Merritt
*Attorney, Agent, or Firm*—Cushman, Darby & Cushman

[57] ABSTRACT

A fuel injection valve for injecting fuel pumped from a fuel injection pump into a combustion chamber of an internal combustion engine, comprises a valve housing with a fuel inlet and fuel injection openings, a nozzle attached to the valve housing, a first fuel passage for communicating the injection openings with the fuel inlet, a first slidable needle valve element, a first spring for urging the first needle valve element so as to close the first fuel passage, a pin disposed for providing an axial gap between the first needle valve element and itself, a second spring for uring the pin towards the first needle valve element, back pressure chambers for surrounding one end portion of the first needle valve element, a second fuel passage for communicating the back pressure chambers with the fuel inlet, an ON-OFF valve for opening or closing the second fuel passage, and an orifice disposed in a bypass passage bypassing the ON-OFF valve.

6 Claims, 6 Drawing Sheets

FUEL INJECTION VALVE USED IN FUEL INJECTION APPARATUS FOR INTERNAL COMBUSTION ENGINE

FIELD OF THE INVENTION AND RELATED ART STATEMENT

The present invention relates to a fuel injection valve used in a fuel injection apparatus for internal combustion engine.

Hitherto, such a kind of valve is opened when a fuel pumped-out pressure which is applied to the pressure receiving area of a needle valve element rises above a preset load of a spring, and this valve is closed when the pressure becomes below the preset load.

To satisfy the recent requirements for the cleaning of the exhaust air and the saving of the fuel consumption, it has been found that it is desirable that a rate of injection slowly increases at early of fuel injection and rapidly decreases at an end of fuel injection and that a pilot fuel injection is performed at a low engine speed.

Therefore, as shown in, e.g., Japanese Patent Examined Publication No. 59-48302, there has been known an apparatus in which a back pressure chamber associated with a needle valve element is provided and a motion of the needle valve element is controlled by hydraulic pressure in the back pressure chamber.

However, in such conventional apparatuses, the hydraulic pressure source is necessary and only the slow increase in fuel injection rate can be obtained. According to another conventional example, only the instantaneous decrease in fuel injection rate at end of fuel injection is obtained. According to still another example, there has been provided a valve which is designed so as to slowly increase the fuel injection rate at early of the injection and to instantaneously reduce the fuel injection rate at end of the injection. However, its effect is not satisfactory. Further, it is quite impossible to obtain both of the foregoing change in the injection rate and the pilot fuel injection by the same valve.

OBJECT AND SUMMARY OF THE INVENTION

It is an object of the present invention to provide a fuel injection valve of a simple constitution which can simultaneously accomplish both a slow increase in the fuel injection rate at the early stage of the injection and an instantaneous decrease in the fuel injection rate at the end of the injection, and which can also perform the pilot fuel injection in the whole rotational speed range or in a special rotational speed range.

To this end, according to the present invention, provided is a fuel injection valve comprising a valve housing, a nozzle portion attached to the valve housing, a fuel inlet provided in the valve housing for receiving the fuel pumped out from an operating chamber of a fuel injection pump through a communicating passage, fuel injection opening means provided in the nozzle portion for injecting the fuel into the combustion chamber, a first fuel passage provided in the valve housing for communicating the injection opening means with the fuel inlet, a first needle valve element slidably disposed in the nozzle portion for opening or closing the first fuel passage, a first spring disposed in the valve housing for coming into contact with one end portion of the first needle valve element away from said combustion chamber and for urging the first needle valve element so as to close the first fuel passage, a pin device disposed in the valve housing for providing an axial gap between the pin device and the one end portion of the first needle valve element, a second spring disposed in the valve housing for urging the pin device towards the first needle valve element, back pressure chamber means formed in the valve housing for surrounding at least the one end portion of the first needle valve element, a second fuel passage provided in the valve housing for communicating the back pressure chamber means with the fuel inlet, an ON-OFF valve for opening or closing the second fuel passage, and orifice means disposed in a bypass passage bypassing the ON-OFF valve.

The operations and effects of the present invention will become more apparent from the following detailed description of the preferred embodiments with reference to the accompanying drawings.

DETAILED DESCRIPTION OF PREFERRED EMBODIMENTS

Figure 1:
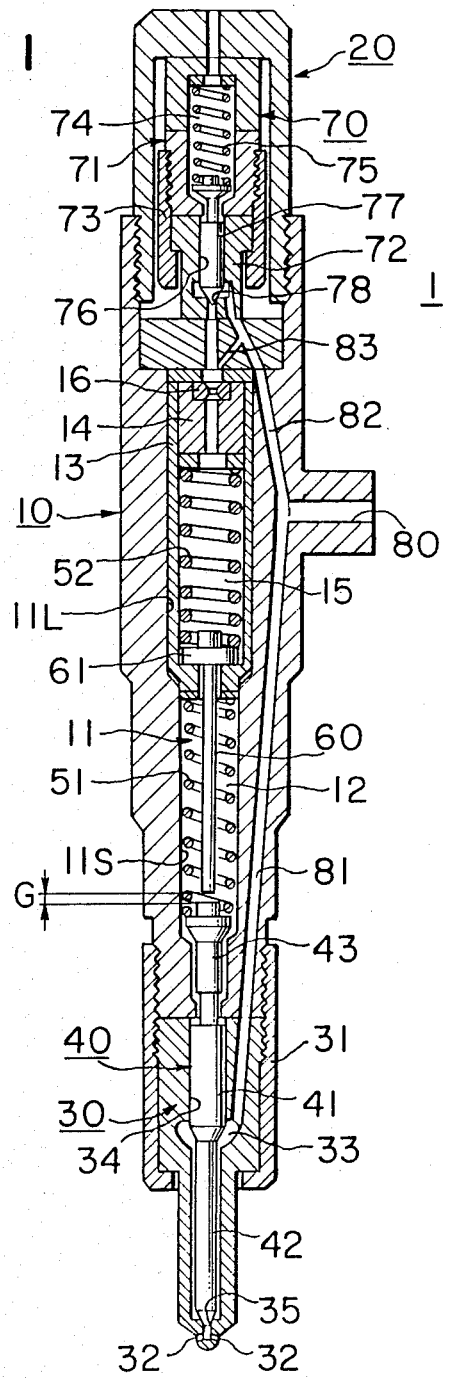
FIG. 1 shows a vertical sectional view of a valve according to the first embodiment.

Referring to FIG. 1, a fuel injection valve 1 has a tapered valve housing 10, a head cap 20 which is screw mounted to an enlarged end portion of the valve housing 10, and an end nozzle 30 which is coupled to a tapered end of the valve housing 10 by a mounting sleeve 31. A needle valve element 40 is disposed in the fuel injection valve 1. The needle valve element 40 has a large diameter portion 41, a small diameter portion 42 coupled with one end portion of the large diameter portion 41, and a flared tail end portion 43 which is screw mounted to the other end portion of the large diameter portion 41.

Injection openings 32, 32 and a pressurized fuel chamber 33 are formed in the end nozzle 30. The large diameter portion 41 of the needle valve element 40 oil-hermetically slides through the bore 34. The injection openings 32, 32 and the pressurized fuel chamber 33 are communicated or discommunicated with each other in dependence on whether or not the end portion of the small diameter portion 42 of the needle valve element 40 is seated on a seat 35 of the nozzle 30.

The valve housing 10 is formed with a bore 11 having a large diameter portion 11L forming a first back pressure chamber 12 and a small diameter portion 11S coupled with the large diameter portion 11L. A sleeve 13 is inserted into the large diameter portion 11L. A first compression spring 51 is disposed between a tapered end of the sleeve 13 and a flared end of the needle valve element 40. A preset load is applied to the needle valve element 40 by the first compression spring 51. A pin 60 is arranged in the bore 11, which is provided at one end thereof with a flange 61. At the flange 61, the pin 60 is urged with a preset load by a second compression spring 52 in a second back pressure chamber 15 which is defined by the sleeve 13 and an adjusting member 14. The preset load can be adjusted by changing the length of adjusting member 14. Thus, the flange 61 is seated onto the end of the sleeve 13 and the other end portion of the pin 60 is projected into the small diameter portion 11S of the bore 11 so as to provide a predetermined gap G between the other end portion of the pin 60 and the flared end of the needle valve element 40 on the seat 35.

An ON-OFF valve 70 is disposed in the head cap 20. The ON-OFF valve 70 has a first valve housing half 71 consisting of two members and a second valve housing half 72 coupled with the first valve housing half 71 by a mounting sleeve 73. A third compression spring 75 is disposed in a cavity 74 formed in the first valve housing half 71. The compression spring 75 urges a needle valve element 77 at one end thereof, with a preset load. The needle valve element 77 oil-hermetically slides in a bore 76. The bore 76 is formed in the second valve housing half 72. Thus, a tapered end of the needle valve element 77 is seated to a seat 78 formed on the second valve housing half 72, thereby closing the ON-OFF valve 70.

The fuel injection valve 1 is formed with a first fuel passage 81 and a second fuel passage 82. The first fuel passage 81 and a second fuel passage 82. The first fuel passage 81 communicates a fuel inlet 80 for receiving the fuel pumped from a fuel injection pump (not shown) with the pressurized fuel chamber 33 so as to supply the fuel into an engine cylinder (not shown). The second fuel passage 82 communicates the fuel inlet 80 with the back pressure chambers 15 and 12 through the ON-OFF valve 70 and an orifice 16 formed in the adjusting member 14.

The operation of the first embodiment will now be explained hereinunder.

A part of the fuel pumped from the fuel pump (not shown) through the fuel inlet 80 flows through the second fuel passage 82 to the ON-OFF valve 70. The remaining fuel flows through the first fuel passage 81 into the pressurized fuel chamber 33.

In association with the increase in pressure of the fuel, when this pressure has reached a first valve opening pressure (which is determined by the load of the first compression spring 51 and the fuel pressure applied to the needle valve element 40) of the fuel injection valve 1 (time A in FIG. 2), the needle valve element 40 is moved away from the seat 35 against the spring 51, thereby opening the fuel injection valve 1.

Figure 2:
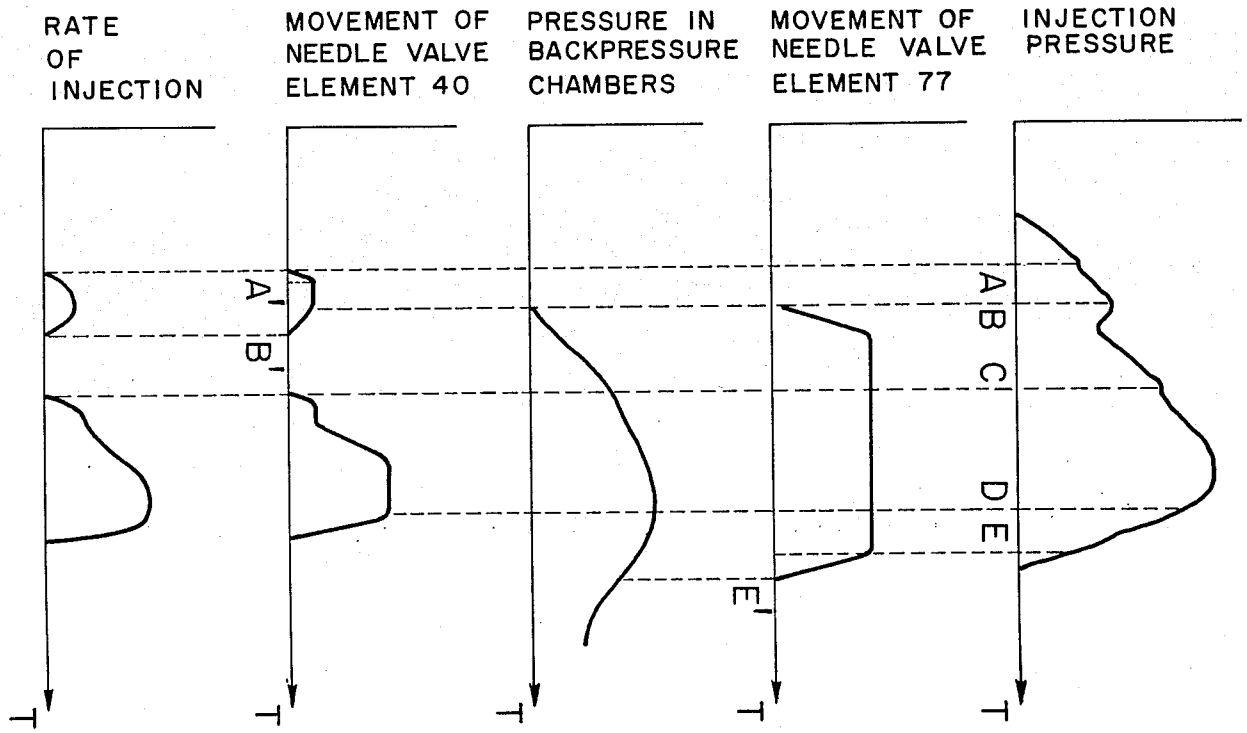
FIG. 2 shows time charts of the respective characteristics of the valve shown in FIG. 1.

When the needle valve element 40 is moved away from the seat 35 by a distance of the preset gap G, it comes into contact with the pin 60 and stops (time A' in FIG. 2). Since the fuel injection valve 1 is open in this state, the fuel is injected into the engine cylinder.

However, since the needle valve element 40 moves by the distance of the gap G, the opening degree of the first fuel passage 81 is small and the fuel pumping pressure is also still small, so that the fuel injection rate is small.

Subsequently, when the fuel is further pumped, the fuel pressures in the fuel passages 81 and 82 increase because the opening degree of the passage 81 is small. On the other hand, when the fuel pressure has reached a valve opening pressure (which is determined by the set load of the third compression spring 75 and the fuel pressure applied to the needle valve element 77) of the ON-OFF valve 70, the needle valve element 77 is moved away from the seat 78 against the spring 75, thereby opening the ON-OFF valve 70 (time B n FIG. 2). Thus, a part of the fuel from the second fuel passage 82 flows through the orifice 16 into the second back pressure chamber 15. Since the second back pressure chamber 15 is communicated with the first back pressure chamber 12, the fuel also flows into the first chamber 12, so that the pressures in the chambers 12 and 15 are equalized.

At this time, a force, which is equal to the product of the pressure in the back pressure chambers 12 and 15 and the cross sectional area of the flared end of the needle valve element 40, acts on the needle valve element 40 so as to close the fuel injection valve 1. Consequently, the needle vave element 40 is put onto the seat 35 and the fuel injection valve 1 is closed (time B' in FIG. 2) and the fuel injection is temporarily stopped.

Since the fuel injection valve 1 is closed, the fuel pressure in the first and the second fuel passages 81 and 82 further increases. When this fuel pressure has exceeded the resultant force of the pressing force of the first compression spring 51 and the force by the fuel pressure in the first chamber 12, namely, when it has exceeded the second opening pressure (which has already been higher than the first one) (time C in FIG. 2), the needle valve element 40 is again removed from the seat 35, so that the fuel injection valve 1 is opened again to restart the fuel injection.

When the fuel pressure further increases, since the ON-OFF valve 70 has already been open, the increased pressure compresses the spring 51 and also compresses the spring 52. Thus, the main fuel injection is executed.

After the fuel injection of a predetermined amount was subsequently executed, the fuel which is supplied is reduced and the pressure in the fuel passages 81 and 82 decreases. At this time, since the orifice 16 is provided, the pressure in the back pressure chambers 12 and 15 decreases slower than the pressure in the fuel passages 81 and 82, so that the pressure in the back pressure chambers is always higher than that in the passages 81 and 82. This pressure difference is adjusted by the orifice 16.

Since the force to close the valve 1 due to the resultant force of the force by the pressure difference and the spring forces of the springs 51 and 52 is extremely enlarged (i.e., the valve closing pressure rises), the needle valve element 40 is promptly put on the seat 35, thereby closing the fuel injection valve 1 (time D in FIG. 2).

When the pressure further decreases, the ON-OFF valve 70 is also closed (time E to E' in FIG. 2) and the valve 1 enters the state as shown in FIG. 1.

At this time, the fuel is still left in the back pressure chambers 12 and 15. However, the fuel having the reduced pressure flows into the fuel passage 82 through a bypass throttle passage 83 and the pressure is returned to the low pressure level until the next fuel injection is executed.

Although the bypass throttle passage 83 is always open, since its cross sectional area is set to be small, the initial fuel amount flowing through the bypass throttle passage 83 is so small that an influence is hardly executed when the valve 1 is opened.

In some engines, there is a case where it is sufficient to merely reduce the fuel injection rate at the early stage of fuel injection without the pilot injection. In this case, the fuel injection valve of the invention can be also used as it is.

In such a case, for example, by setting the valve opening pressure of the ON-OFF valve 70 to be higher than the third valve opening pressure which is determined by the second spring 52, and by opening the fuel injection valve 1 after the needle valve element 40 is fully removed from the seat 35, the purpose of such case can be accomplished.

In this case, the fuel injection valve 1 is not closed during the fuel injection, so that no pilot injection is executed. However, since the needle valve element 40 moves in a stepwise manner and the opening degree of the passage is small in the case of the movement of the needle valve element 40 in the first step, the injection rate can be slowly increased by reducing the injection rate at the early stage of fuel injection. At the same time, when the fuel injection valve 1 is closed, the pressures in the back pressure chambers 12 and 15 are increased by opening the ON-OFF valve 70, so that the valve closing force increases, thereby enabling the valve 1 to be promptly closed.

On the other hand, in a single engine, by adjusting the valve opening pressure of the ON-OFF valve 70 and the orifice 16, in the low rotational speed range in which the injection rate of the fuel per unit time is small, the pilot injection can be performed, while in the high rotational speed range in which the injection rate is large, by reducing the pressures in the back pressure chambers so as not to temporarily close the fuel injection valve during the injection and by arranging the pressure of the fuel to be suppllied higher than the pressures in the back pressure chambers, the pilot injection is not performed but the fuel injection can be executed with merely reduced injection rate at early of fuel injection.

In the embodiments which will be explained hereinafter, the same parts and components having the same functions as those shown in the foregoing first embodiment are designated by the same reference numerals.

Figure 3:
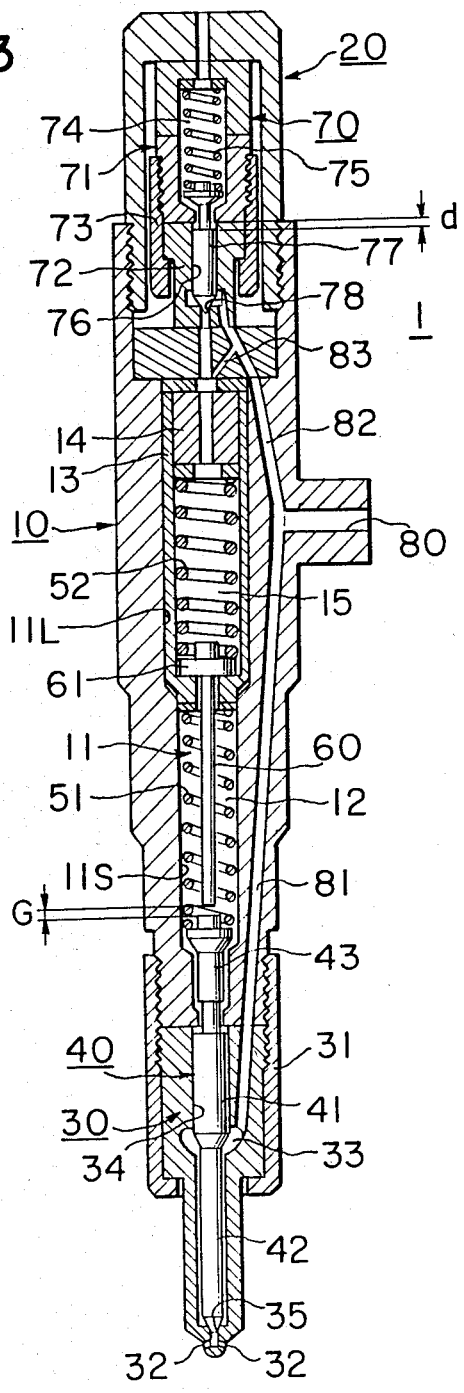
FIG. 3 shows a vertical sectional view of a valve according to the second embodiment.

The second embodiment shown in FIG. 3 differs from he first embodiment in that the orifice 16 is omitted. In the second embodiment, the opening degree of the passage 82 can be reduced by restricting the maximum amount of movement (indicated at d in FIG. 3) of the needle valve element 77 constituting the ON-OFF valve 70 from the seat 78 so as to be a small value. In other words, in the second embodiment, the ON-OFF valve 70 is used in place of the orifice 16. Therefore, the fundamental operation of the second embodiment is substantially the same as that in the first embodiment and, accordingly, its description is omitted.

On the other hand, the position of the bypass throttle passage 83 is not limited to that shown in FIG. 1. The passage 83 may be also provided to another position, e.g., the valve housing 10.

Figure 4:
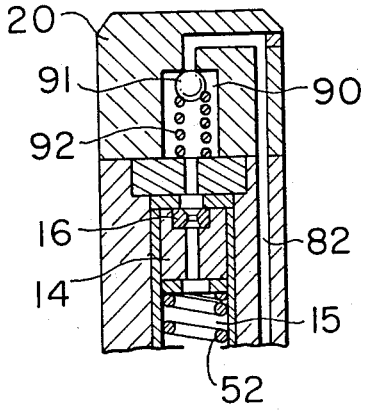
FIG. 4 shows a fragmentary vertical sectional view of a valve according to the third embodiment.

FIG. 4 shows the third embodiment in which only the constitution of the ON-OFF valve differs from that in the foregoing embodiments.

In FIG. 4, a check valve 90 having a ball valve element 91 is used as an ON-OFF valve in place of the ON-OFF valve 70 having the needle valve element 77 in the first and second embodiments. By use of the check valve 90 which is made operative by the pressure difference between the pressure in the fuel passage 82 and the pressure in the back pressure chamber 15, the constitution is fairly simplified. Further, when the pressures in the chambers 12 and 15 is abnormally increased in the special operating state, such pressure difference decreases. Thus, there are effects such that it becomes difficult to open the valve and the inflow of the fuel into the back pressure chambers can be limited.

The present invention can be applied to the fuel injection valve of the type having a piston which operates substantially integrally with the needle valve element (e.g., the valve shown in Japanese Patent Examined Publication No. 59-48302). In this case, the pressure chamber which is associated with the piston is used as the back pressure chamber.

In addition, a solenoid valve may be used as the ON-OFF valve so as to be accurately electrically controlled.

Figure 5:
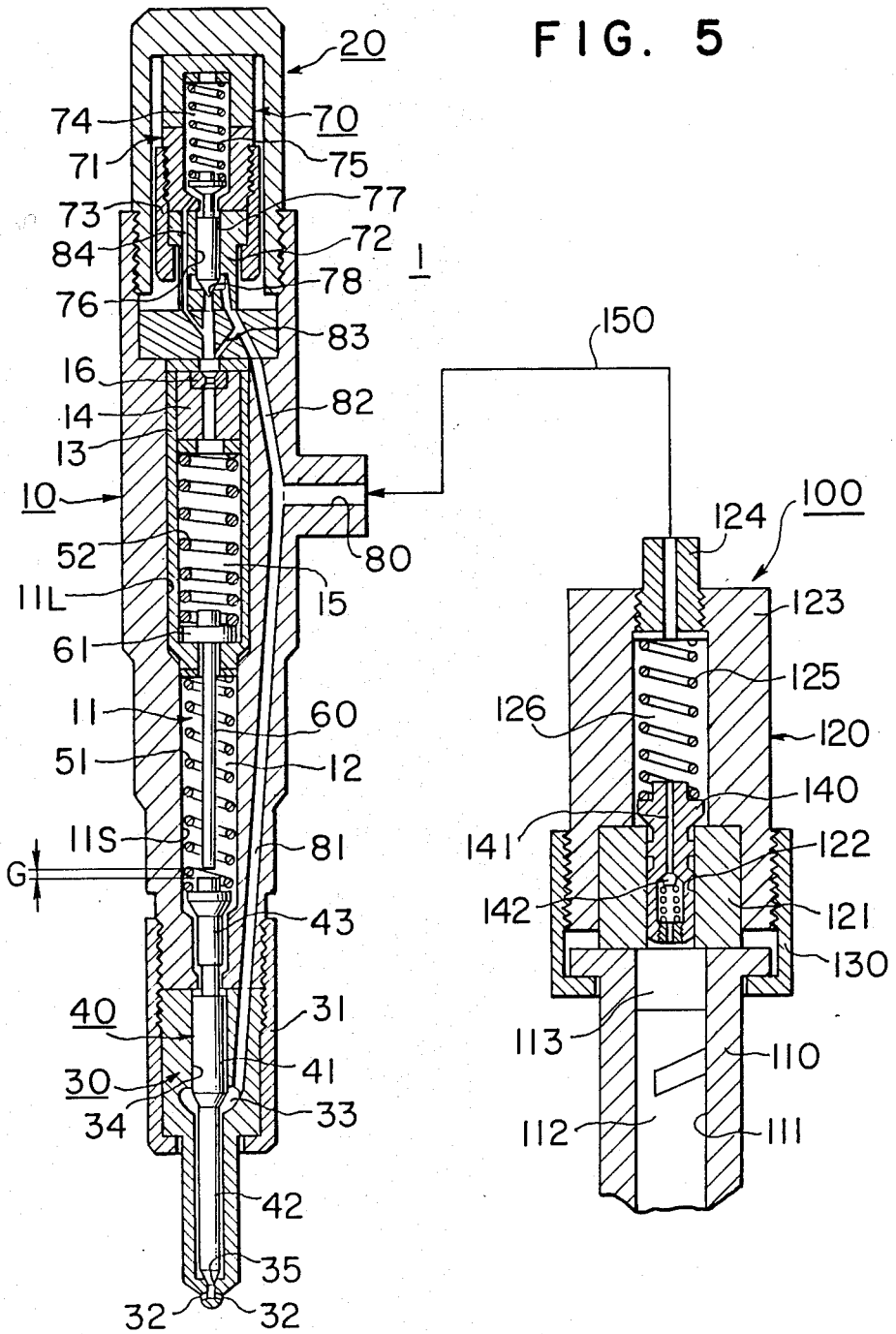
FIG. 5 shows a vertical sectional view of a valve according to the fourth embodiment.

FIG. 5 shows the fourth embodiment. The fuel injection valve 1 in the fourth embodiment is connected to a fuel injection pump 100 through the fuel inlet 80.

The pump 100 has a pump cylinder 110 having a central through bore 111 and a discharge valve 120 attached to the pump cylinder 110 by a mounting sleeve 130.

A plunger 112 is oil-hermetically slidably disposed in the through bore 111 of the pump cylinder 110. The plunger 112 cooperates with the discharge valve 120 to define a fuel pressure chamber 113 of a variable capacity. The fuel is supplied from a fuel chamber (not shown) into the fuel pressure chamber 113 through a feed hole (not shown). The supplied fuel is pressurized by the movement of the plunger 112.

The discharge valve 120 comprises a retainer 121 provided with a through bore 122 through which a plunger 140 slides, a valve body 123, and an end plug 124.

The plunger 140 is urged to the fuel pressure chamber 113 by a valve spring 125 disposed in a discharge chamber 126 which is defined by the plunger 140, valve body 123, and end plug 124. On the other hand, the plunger 140 is provided with a communicating passage 141 for communicating the fuel pressure chamber 113 with the discharge chamber 126. A check valve 142 is disposed within the communicating passage 141 so as to allow the fuel to flow from the discharge chamber 126 into the fuel pressure chamber 113.

When the fuel in the fuel pressure chamber 113 is pressurized to a level above the valve opening pressure of the plunger 140, the pressurized fuel moves the plunger 140 against the spring force of the valve spring 125, thereby allowing the fuel to flow into the discharge chamber 124. The pressurized fuel in the discharge chamber 124 is supplied to the fuel injection valve 1 through a passage 150.

The fuel injection valve 1 is substantially the same as that shown in FIG. 1 excluding that a throttle passage 84 is formed in the ON-OFF valve 70 to communicate the cavity 74 thereof with the back pressure chamber 15.

The operation of the fuel injection valve in the fourth embodiment will now be explained.

The pressurized fuel from the fuel injection pump 100 is supplied to the fuel inlet 80 through the passge 150. Thereafter, a part of the fuel is fed to the ON-OFF valve 70 through the passage 82 and the remaining fuel is fed to the pressurized fuel chamber 33.

In association with the increase in pressure of the fuel, when this pressure has reached a first valve opening pressure (which is determined by the load of the first compression spring 51 and the fuel pressure applied to the needle valve element 40) of the fuel injection valve 1 (time A in FIG. 6), the needle valve element 40 is away from the seat 35 against the spring 51, thereby opening the fuel injection valve 1.

Figure 6:
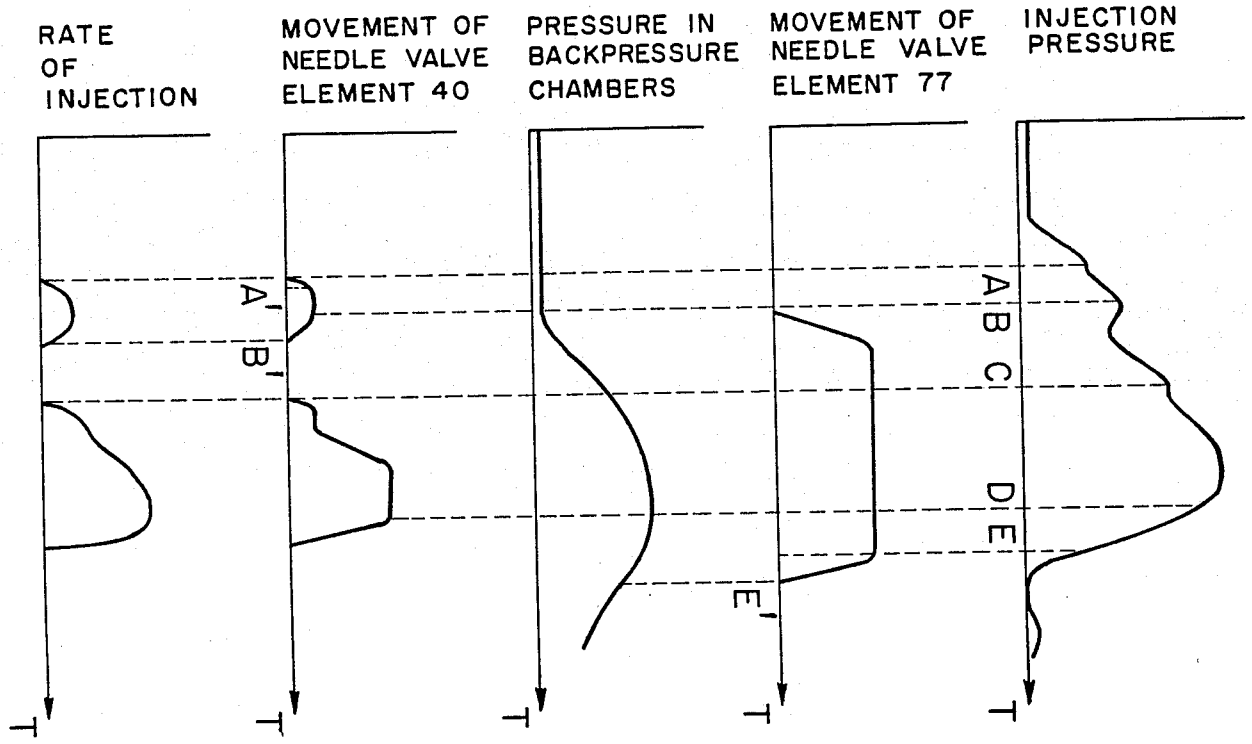
FIG. 6 shows time charts of the respective characteristics of the valve shown in FIG. 5.

When the needle valve element 40 is moved away from the seat 35 by a distance of the preset gap G, it comes into contact with the pin 60 and stops (time A' in FIG. 6). Since the fuel injection valve 1 is open in this state, the fuel is injected into the engine cylinder.

However, since the needle valve element 40 moves by the distance of the gap G, the opening degree of the first fuel passage 81 is small and the fuel pumping pressure is also still small, so that the fuel injection rate is small.

When the fuel is further supplied, the fuel pressure increases. When the fuel pressure has reached the valve opening pressure (which is determined by the set load of the third compression spring 75 and the fuel pressure applied to the needle valve element 77) of the ON-OFF valve 70, the needle valve element 77 is removed from the seat 78 against the spring 75, thereby opening the ON-OFF valve 70 (time B in FIG. 6). Thus, the pressurized fuel from the fuel passage 82 flows into a cavity (i.e., back pressure chamber) 74 of the ON-OFF valve 70 through the throttle passage 84 and also flows into the back pressure chamber 15 through the orifice 16. On the other hand, since the chamber 15 is communicated with the back pressure chamber 12, the fuel also further flows into the chamber 12. Thus, all of the pressures in the back pressure chambers 12, 15 and 74 are equalized.

At this time, a force, which is equal to the product of the pressure in the back pressure chamber 12 and the cross sectional area of the flared end of the needle valve element 40, is applied to the needle valve element 40 so as to close the valve. Thus, the needle valve element 40 is put on the seat 35 and the fuel injection valve 1 is closed (time B' in FIG. 6), thereby temporarily stopping the fuel injection.

Since the fuel injection valve 1 is closed, the fuel pressure in the first and the second fuel passages 81 and 82 further increases. When this fuel pressure has exceeded the resultant force of the pressing force of the first compression spring 51 and the force by the fuel pressure in the first chamber 12, namely, when it has exceeded the second opening pressure (which has already been higher than the first one) (time C in FIG. 6), the needle valve element 40 is again removed from the seat 35, so that the fuel injection valve 1 is opened again to restart the fuel injection.

When the pressurized fuel is further supplied, since the ON-OFF valve 70 is open, the needle valve element 40 is further removed from the seat 35 against the first and the second springs 51 and 52 due to the increase in fuel pressure, so that the main injection is performed.

Thereafter, when the injection is performed by only a predetermined amount of fuel, an amount of fuel supply is reduced and the pressure in the fuel passages 81 and 82 decreases. At this time, since the orifice 16 is provided, the pressure in the back pressure chambers 12 and 15 decreases slower than the pressure in the fuel passages 81 and 82. Thus, the pressure in the chambers 12 and 15 is always higher than the pressure in the fuel passages 81 and 82 and its pressure difference is adjusted by the orifice 16.

The valve closing force, on the basis of the resultant force of the force due to the pressure difference and the pressing forces of the springs 51 and 52, extremely increases (namely, the valve closing pressure rises). Thus, the needle valve element 40 is rapidly put on the seat 35 and the fuel injection valve 1 is closed (time D in FIG. 6).

On the other hand, since the pressure in the back pressure chamber 74 also decreases slower than the pressure in the fuel passages 81 and 82, the resultant force of the pressing force due to the fuel in the back pressure chamber 74 and the pressing force of the spring 75 acts on the needle valve element 77 so as to close the ON-OFF valve 70. In association with the reduction of the pressure in the fuel passages 81 and 82, the ON-OFF valve 70 is also closed (time E to E' in FIG. 6). The valve enters the state as shown in FIG. 5.

At this time, the fuel still remains in the back pressure chambers 12 and 15. However, the remaining fuel having the reduced pressure through the bypass throttle passage 83 flows into the fuel passage 82. The residual fuel is further returned to the fuel injection pump 100 through the passage 150. The fuel reversely flows into the fuel pressure chamber 113, i.e. the low pressure side sequentially through the communicating passage 141 and the check valve 142 both provided in the plunger 140. Therefore, the pressures in the back pressure chambers 12 and 15, in the fuel passages 81 and 82, and in the passage 150 are returned to the low level until the next fuel injection is performed. The residueal pressure in the fuel pressure chamber 113 is effectively used as a pressure energy in the next pressurizing process of the fuel injection pump 100. Consequently, the problem of the loss of energy is not caused.

Further, it is also possible to prevent the occurrence of the abnormal injection and non-injection and the fluctuation of the fuel injection amount due to the double operations of the increase in pressure of the residual fuel in the back pressure chambers 12 and 15 and the fuel passages 81 and 82 and the increase in the valve opening pressure of the needle valve element 40 in the low rotational speed range.

As described above, with the constitution of the embodiment, it is possible to accomplish the pilot injection in the whole rotational speed range or in the special rotational speed range.

The fifth embodiment of the invention will now be explained with reference to FIG. 7. The embodiment of FIG. 7 shows a modified form of the plunger 140 of the discharge valve 120 of the fuel injection pump 100.

Figure 7:
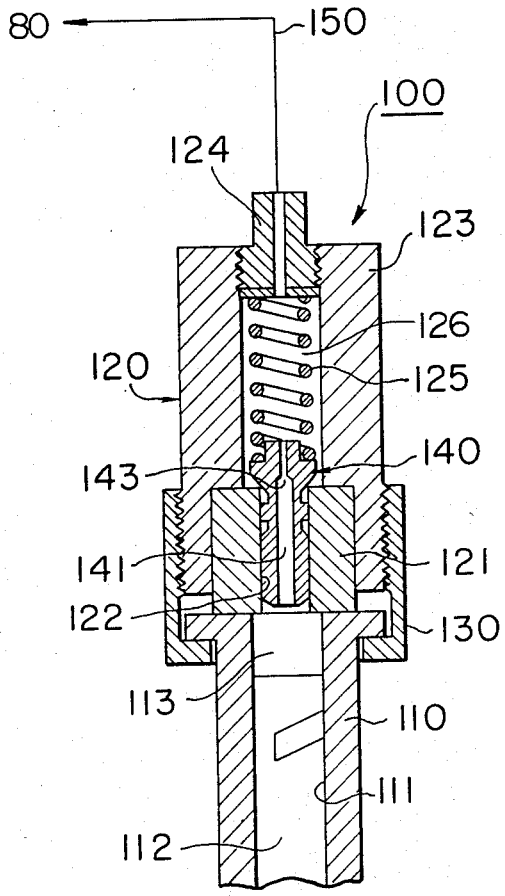
FIG. 7 shows a fragmentary vertical sectional view of a valve according to the fifth embodiment.

In FIG. 7, the plunger 140 of the discharge valve 120 is provided with the communicating passage 141. An orifice 143 is formed in a portion of the communicating passage 141 adjacent to the discharge chamber 126. Namely, after completion of the fuel injection the reverse flow of the residual fuel is returned through the orifice 143 to the chamber 113 so as to return the pressure thereof to a low level. According to this embodiment, the aforementioned effect can be attained by the simple constitution.

As described above, according to the present invention, although the constitution is simple, the slow increase in injection rate at early of the injection and the instantaneous decrease in injection rate at end of the injection can be simultaneously realized and the pilot injection can be also executed. There are such remarkable effects that the exhaust air is cleaned, the fuel consumption is saved, and the noise is also reduced.

In addition, according to the invention, the injection rate pattern to simultaneously accomplish both of the slow increase in injection rate at early of the injection and the instantaneous decrease in injection rate at end of the injection can be realized by effectively using the pressure energy of the residual fuel after completion of the injection without losing the energy and further without causing the abnormal fuel injection and the fluctuation of the fuel injection amount due to the fluctuation of the remaining pressure. Moreover, it is also possible to prevent the abnormal injection and the variation of injection amount by the fluctuation of the residual pressure.

What is claimed is:

1. A fuel injection valve for injecting a fuel into a combustion chamber of an internal combustion engine, said valve comprising:

a valve housing;

a nozzle portion attached to said valve housing;

a fuel inlet provided in said valve housing for receiving the fuel pumped out from an operating chamber of a fuel injection pump through a communicating passage;

fuel injection opening means provided in said nozzle portion for injecting th fuel into the combustion chamber;

a first fuel passage provided in said valve housing for communicating said injection opening means with said fuel inlet;

a first needle valve element slidably disposed in said nozzle portion for opening or closing said first fuel passage;

a first spring disposed in said valve housing for coming into contact with one end portion of said first needle valve element away from said combustion chamber and for urging said first needle valve element so as to close said first fuel passage;

a pin device disposed in said valve housing for providing an axial gap between said pin device and said one end portion of said first needle valve element;

a second spring disposed in said valve housing for urging said pin device towards said first needle valve element;

back pressure chamber means formed in said valve housing for surrounding at least said one end portion of said first needle valve element;

a second fuel passage provided in said valve housing for communicating said back pressure chamber means with said fuel inlet;

an ON-OFF valve means for opening or closing said second fuel passage, said ON-OFF valve means including a valve element and a third spring, which is separate from said second spring, for pressing said valve element so as to close said second fuel passage;

orifice means disposed in a bypass passage bypassing said ON-OFF valve means, and communicating with said back pressure chamber, said orifice means communicating with said fuel inlet.

2. A fuel injection valve according to claim 1, wherein said first and said second springs are housed in said back pressure chamber means.

3. A fuel injection valve according to claim 1, wheein said valve element of said ON-OFF valve means is a second needle valve element.

4. A fuel injection valve according to claim 1, wherein said ON-OFF valve means includes a check valve having a ball valve element and a spring.

5. A fuel injection valve according to claim 1, wherein said communicating passage is provided with means for allowing the flow of the fuel from said fuel inlet into said operating chamber of said fuel injection pump, which operating chamber is a high pressure pumping chamber on fuel pumping.

6. A fuel injection valve according to claim 5, wherein said means is a check valve.

* * * * *